US006049680A

United States Patent [19]

Goris et al.

[11] Patent Number: 6,049,680

[45] Date of Patent: Apr. 11, 2000

[54] APPARATUS FOR CONDITIONING MOISTURE CONTENT TEMPERATURE OF MEDIA

[75] Inventors: Freddy Goris, Heist o/d Berg; Luc Hooyberghs, Retie; Luc Baeten, Nijlen, all of Belgium

[73] Assignee: Agfa Gevaert N.V., Mortsel, Belgium

[21] Appl. No.: 09/297,000

[22] Filed: Apr. 22, 1999

Related U.S. Application Data

[60] Provisional application No. 60/101,159, Sep. 21, 1998.

[30] Foreign Application Priority Data

May 8, 1998 [EP] European Pat. Off. ..... 98201502

[51] Int. Cl.[7] ..... G03G 15/00

[52] U.S. Cl. ..... 399/44; 399/45

[58] Field of Search ..... 399/45, 44, 389, 399/390; 34/117, 118, 119, 114

[56] References Cited

U.S. PATENT DOCUMENTS 5,539,498 7/1996 De Cock et al. ..... 399/44
5,887,236 3/1999 Hirao et al. ..... 399/330

FOREIGN PATENT DOCUMENTS 0629925 12/1994 European Pat. Off. .
0675417 10/1995 European Pat. Off. .
59-013260 1/1984 Japan .

*Primary Examiner*—William Royer
*Assistant Examiner*—Greg Moldafsky
*Attorney, Agent, or Firm*—Robert A. Sabourin

[57] ABSTRACT

An apparatus (11) for conditioning media, for example a moving web (12) of receptor material in an electrostatographic printer (10), is described. The apparatus (11) comprises a heating system, such as a heated drum (55), to adjust the moisture content of the media and a cooling system (65) for cooling the heated media. A moisture sensor such as an electrometer (74) determines the moisture content e.g. by an electrical condition of the media before it leaves the apparatus (11). The moisture sensor (74) controls the heating system (55). A temperature sensor (81) determines the temperature of the media after cooling. This sensor (81) may control the cooling system (65) or other parameters of the system. By conditioning a receptor material in an electrostatographic printer, a higher yield of toner transfer can be obtained. Optionally two electrometers (74*a*, 74*b*) are used to thereby detect the charge decay on an earthed metal drum (72). By sensing the moisture at a constant temperature or by control of specific system parameters by the temperature signal, a stable control circuitry (101, 83) is achieved.

12 Claims, 4 Drawing Sheets

APPARATUS FOR CONDITIONING MOISTURE CONTENT TEMPERATURE OF MEDIA

This application claims the benefit of U.S. Provisional Application No. 60/101,159 filed Sep. 21, 1998 and European patent application No. EP98201502.6 filed May 8, 1998.

FIELD OF THE INVENTION

The present invention relates to an apparatus for conditioning media. In a specific embodiment, the invention relates to conditioning a moving web of receptor material, prior to entry into an electrostatographic printer. An electrostatographic printing apparatus is intended for making a large number of prints and finds use, e.g., in the field wherein classical offset printing machines are applied for making thousands of prints in a single run.

BACKGROUND OF THE INVENTION

Electrostatographic printing operates according to well known principles such as electrographic printing in which an electrostatic charge is deposited image-wise on a dielectric recording member. According to another technique, referred to as Direct Electrostatic Printing (DEP) as described in EP-A-0 675 417, toner particles are imagewise deposited on a substrate without the use of an electrostatic latent image. A cloud of toner particles is supplied to a mesh of apertures, where each aperture has its own control electrode to control the amount of toner propelled through the aperture onto a substrate on which the image must be formed. Electrostatographic printing also includes electrophotographic printing in which an overall electrostatically charged photoconductive dielectric recording member is image-wise exposed to conductivity increasing radiation producing thereby a "direct" or "reversal" toner-developable charge pattern on said recording member. The toner image is transferred onto a printing stock material, usually paper or a synthetic material such as PET (polyethyleneterephthalate) in the form of a web whereon the toner image is fixed, whereupon the web is cut into sheets containing the desired print frame. As can be learned from the book "The Physics and Technology of Xerographic Processes" by E. M. Williams (1984), Chapter Ten, p. 204 et seq the transfer of developed toner images onto paper proceeds by means of electrical corona devices to generate the required electric field to attract the charged toner from the electrostatographic recording member to the paper. The transfer efficiency of toner onto the receptor paper or synthetic material is not only dictated by the contact of the paper with the toner-laden recording member and the deposited charge but also by the conductivity of the recording member and particularly by its water content. Moreover, the conductivity may be highly dependent on the type of receptor material, i.e. the difference of conductivity between paper and e.g. PET may be very important. Paper is not a simple insulating dielectric, so the electrical properties of plain paper have some influence on toner transfer. Experiments with a variety of paper types and thicknesses (i.e. weights) have established that heavier papers yield improvement in transfer efficiency. Paper types with high porosity, i.e. high permeability for gases loaded with ions by corona discharge do not allow an efficient toner transfer. Variation in gas permeability or porosity between different paper types is due to overall thickness, degree of filling with clays, sizings, and other paper treating substances. Apart from the paper fibres and said substances which form a constant factor for conductivity or volume resistivity there is the moisture content which fluctuates with the humidity of the environment, especially the environment of the paper storage unit containing the paper on roll. It has been established that as the moisture content increases from about 3 to 10% by weight, the surface resistance of copy paper decreases nearly six orders in magnitude. Dry paper has very good electric insulating behaviour so that thereon by corona discharge a fairly high electrostatic charge can be deposited before breakdown takes place. On using dry receptor paper the toner attraction force caused by said electrostatic charge can be built up with a reasonable corona charge. Since the leakage of charges through the receptor paper is a function of moisture content (paper humidity), a careful control of said moisture content will be in favour of toner transfer efficiency, image quality and reproducibility in toner printing results. A system for control of the moisture content has been proposed in EP-A- 0 629 925. That system includes a heating means, a cooling means and at least one electrometer to derive the moisture content from the electrical conductivity of the paper web and for correcting the heating means on that evaluation of the moisture content. Tests have shown, however, that the measured electrical conductivity is not only a function of the moisture content alone. As a consequence, the heating means may further influence or increase the temperature of the moving paper web in an attempt to lower the moisture content, whereas that moisture content already reached an optimum value. This shows that a problem remains to be solved. Even if other types of sensors are used to assess the moisture content of the media, such as humidity sensors or direct contact resistor sensors, other parameters still influence the relation between the measured value and the absolute moisture content.

OBJECTS OF THE INVENTION

It is an object of the invention to provide an apparatus for conditioning the moisture content of media in a stable, predictive and reproducible manner.

It is another object of the invention to deliver the conditioned media with constant conditions.

It is a specific object of the present invention to provide an electrostatographic printing apparatus with means for controlling the condition of a paper receptor material whereby a higher yield of transferred toner is obtained and consequently less toner waste is formed, thereby reducing or avoiding quality deviations of transferred toner images and, in the case of double-sided (duplex) printing, improved performance may be achieved as a result of limiting the flow of electrostatic charges through the receptor material.

It is still another object of the present invention to provide a method for conditioning a moving paper receptor material to enable subsequent reproducible production of transferred dry toner images thereon.

SUMMARY OF THE INVENTION

The above mentioned objects are realised by an apparatus having the specific features defined in claim 1 and by a method having specific features defined in claim 8. Specific features for preferred embodiments of the invention are set out in the dependent claims.

The media may take the form of a web but the media may as well comprise sheet-like material, such as A4 or A3-sized pages of paper. In a preferred embodiment, the media is moving relative to the heating means and/or cooling means, i.e. some elements may be stationary, some may be moving.

The media may comprise paper, preferably with grammages of 40, 80, 100 or 350 g/m$^2$, or any value within the range of 40–350 g/m$^2$. A paper receptor material may consist of paper or may comprise, for example, paper containing synthetic fibres or paper coated on at least one side with a nonpaper material, for example, with a synthetic polymeric material. The media may also mainly consist of a synthetic material such as PET having preferably a thickness between 12 and 350 $\mu$m. The media may be labels including an adhesive layer or may mainly consist of PVC (polyvinylchloride) or PE (polyethylene). All these media may absorb or adsorb a variable amount of moisture, either during production or during contact with the ambient atmosphere. The apparatus and method according to the current invention may also be used during the production process of these media. Preferably, the media produced have a constant moisture content as they are wound on a roll of web material or packed in a stack of sheets. By making use of the current invention, the moisture condition and the temperature condition may be kept within narrow limits.

The sensor of the moisture content may be realised by a sensor of for measuring the relative humidity. The moisture content may also be assessed by indirect measurement, i.e. by measuring another parameter, related to the moisture content. In a preferred embodiment the conductivity of the media after the heating and cooling steps is measured. The conductivity of the media may be measured by positioning the media between two electrical conductors, both making contact to the media, closely to each other. One conductor may be placed on the front side of the media, the other one on the back side. Alternatively, both conductor may be placed closely adjacent to each other, without making direct contact with each other but both contacting the media.

The media may be a moving paper receptor material suitable for use in an electrostatographic printer. The most important function of the heating means is to reduce the moisture content of the receptor material or media. Preferably, the heating means is enclosed in a heating cabinet having a receptor material entrance, a receptor material exit, means for the entrance of fresh air and exhaust means for expelling moist air produced by heating the receptor material. A cooling cabinet may be provided comprising means for cooling the heated receptor material with dry air to bring its temperature within the range of 15° C. to 40° C. before leaving the apparatus. In a more preferred embodiment, the cooling cabinet may also have the capability to further increase the temperature of the media, e.g. the receptor material, in order to achieve a predetermined temperature. Advantageously, the heating cabinet is connected to a cooling cabinet. Preferably, the conditioning apparatus according to the invention further comprises control means for controlling said heating means, and optionally said cooling means, in response to the electrical condition of the receptor material sensed by said sensing means. Alternatively, the output from the sensing means may be fed to a visual indicator from which the operator may check the condition of the receptor material and make adjustments to the moisture control means to bring the electrical condition of the receptor material within a desired range.

The heating means may comprise a heated rotatable drum or cylinder in contact with at least one side of said receptor material as it moves along said receptor material path. The heating means may comprise a radiant-heat dryer having at least one radiant-heat source positioned to project infrared radiation onto at least one side of the receptor material as it moves along the receptor material path. Preferably, the radiant-heat dryer has a dominant energy output wavelength within the range of from 1.5 $\mu$m to 10 $\mu$m. Alternatively or additionally, the moisture control means may comprise at least one nozzle positioned to direct a stream of hot air onto at least one side of the receptor material as it moves along the receptor material path. The heating means may even be a dielectric dryer containing at least one radio-frequency or microwave source positioned such that the receptor material moves through the electromagnetic field of the source as it moves along the receptor material path. The temperature to which the receptor material is heated by the heating means is preferably at least 120° C., such as about 140° C. or 180° C. Too high a temperature may lead to damage being caused to the receptor material. The receptor material is conditioned to a moisture content of from 1 to 2% by weight, preferably up to 1.5%. We prefer that the moisture content does not fall below 0.5%, since receptor material which is too dry might result in high triboelectric charges to be generated thereon, the discharge of which in the printer may have undesirable effects. The moisture sensing means, also referred to as moisture sensor, may comprise a corona discharge device positioned adjacent the receptor material path to build up a predetermined electrostatic charge on at least one side of the receptor material and, in a first embodiment, means positioned downstream of the corona discharge device for sensing the level of electrostatic charge retained on the receptor material. The supply current fed to the corona discharge device is preferably within the range of 1 to 10 $\mu$A/cm, most preferably from 2 to 5 $\mu$A/cm, depending upon the receptor material characteristics and will be positioned at a distance of from 3 mm to 10 mm from the path of the receptor material. Alternatively, in a second embodiment, means are positioned downstream of the corona discharge device for sensing the decay of electrostatic charge on said receptor material. The means for sensing the decay of electrostatic charge on said receptor material may comprise a plurality of spaced electrometers positioned adjacent said receptor material path and means for comparing output signals from said electrometers. Preferably, a receptor material charge discharging device, such as an AC corona device, is positioned downstream of the charge sensing means for discharging the static charge on the receptor material before it leaves the apparatus. According to a preferred embodiment of the invention, the receptor material conditioning apparatus is coupled to an electrostatographic printer for forming an image onto a receptor material. The printer may comprise at least one toner image-producing electrostatographic station having rotatable endless surface means onto which a toner image can be formed, means for conveying the receptor material past the stations and means for transferring the toner image on the rotatable surface means onto the receptor material. Preferably, the humidity of the atmosphere inside said electrostatographic printer is controlled. This is done with the aim of maintaining the electrical condition of the receptor material within a desired range. In preferred embodiments of the invention the receptor material is in the form of a web, for example supplied from a roll, but the invention is equally applicable to receptor material in the form of separate sheets.

Further advantages and embodiments of the present invention will become apparent from the following description and drawings.

BRIEF DESCRIPTION OF THE DRAWINGS

The invention will now be further described, purely by way of example, with reference to the accompanying drawings, in which.

DETAILED DESCRIPTION OF THE INVENTION

While the present invention will hereinafter be described in connection with preferred embodiments thereof, it will be understood that it is not intended to limit the invention to those embodiments.

Figure 1:
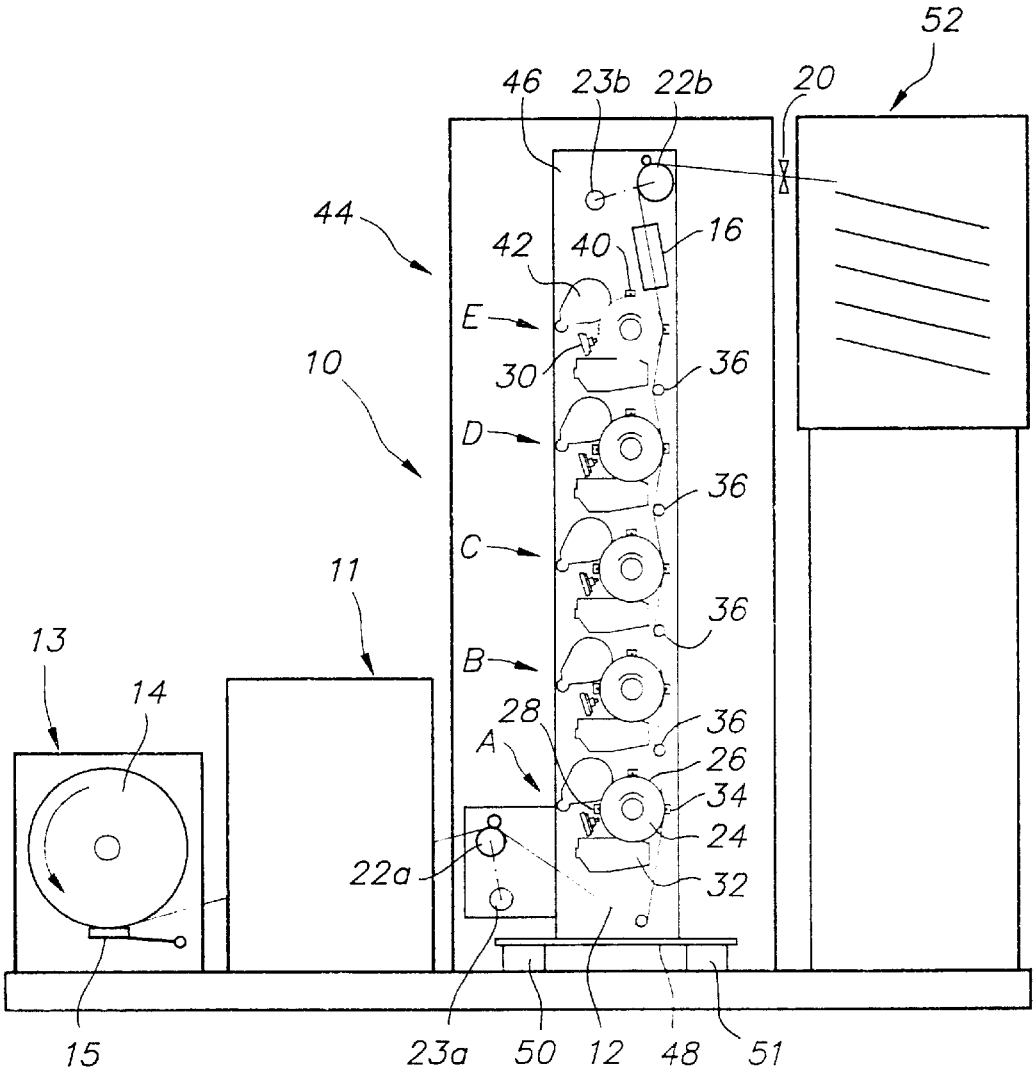
FIG. 1 shows schematically an electrostatographic single-pass multiple station printer, suitable for simplex printing.
Figure 2:
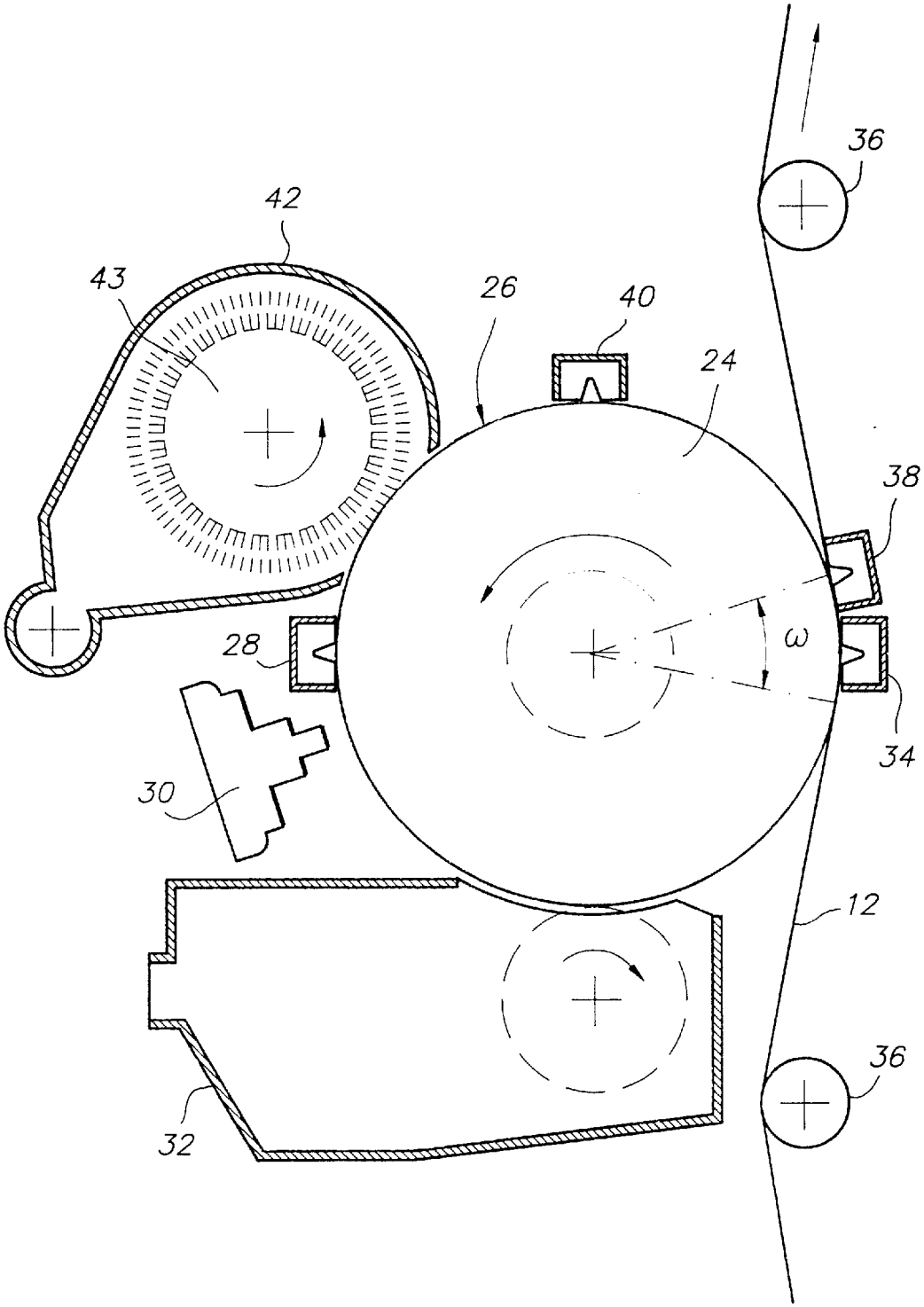
FIG. 2 shows in detail a cross-section of one of the print stations of the printer shown in FIG. 1.
Figure 3:
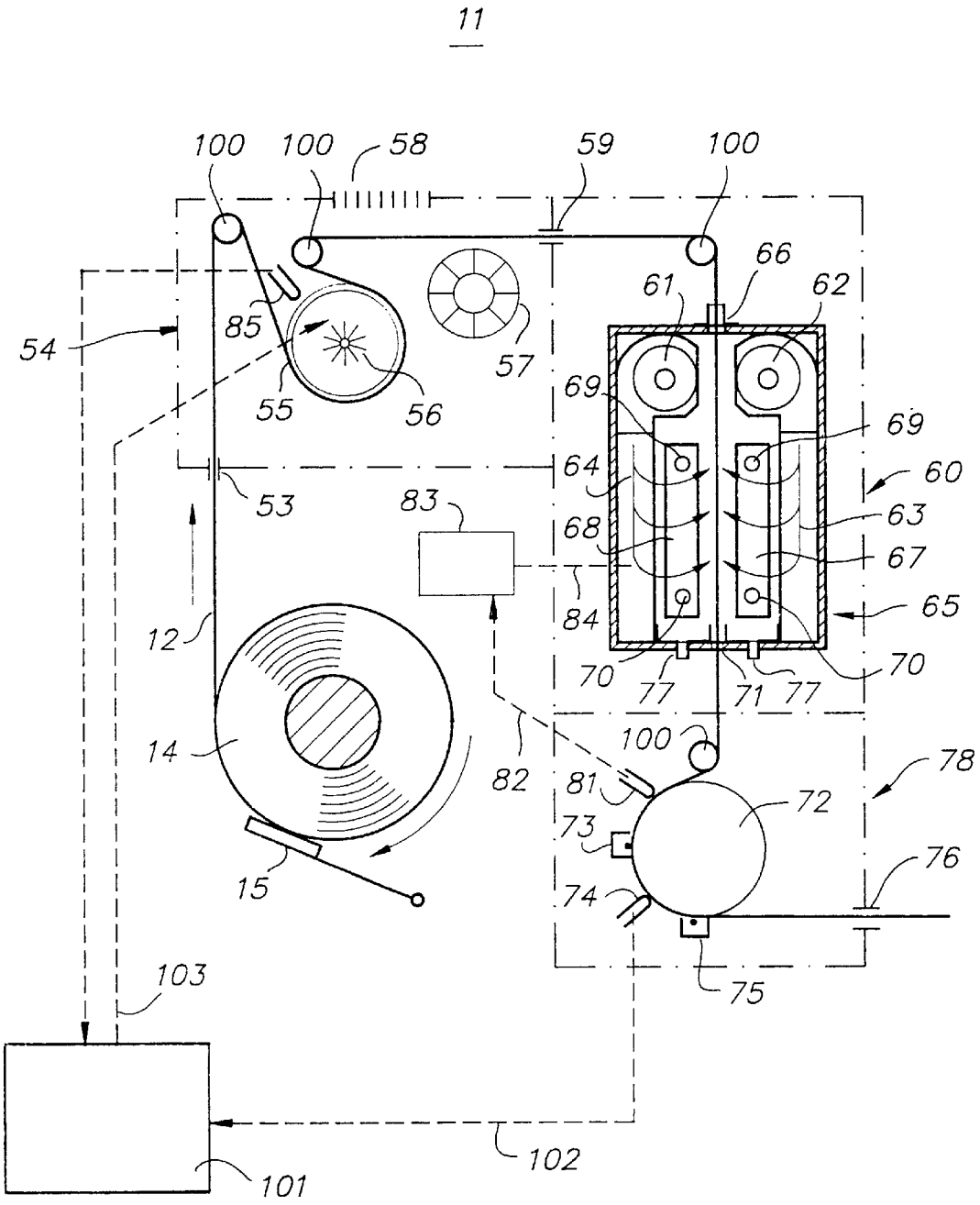
FIG. 3 shows a paper web conditioning apparatus according to the invention, for use with the printer according to FIG. 1.

Referring to FIG. 1, there is shown a printer 10 having a supply station 13 in which a roll 14 of web material 12 is housed in sufficient quantity to print, say, 3 to 5,000 images. The web 12 is conveyed from the supply station 13, through the paper conditioning apparatus 11 into a tower-like printer housing 44 in which a support column 46 is provided, housing four similar printing stations A to D which are arranged to print yellow, magenta, cyan and black images. In addition, a further station E is provided in order to optionally print an additional colour, for example a specially customised colour. The web of paper 12 is conveyed in an upwards direction past the printing stations in turn. The printing stations A to E are mounted in a substantially vertical configuration resulting in a reduced footprint of the printer and additionally making servicing easier. The column 46 may be mounted against vibrations by means of a platform 48 resting on springs 50, 51. After leaving the final printing station E, the image on the web is fixed by means of the image-fixing station 16 and fed to a cutting station 20 (schematically represented) and a stacker 52 if desired. The web 12 is conveyed through the printer by two drive rollers 22*a*, 22*b* one positioned between the conditioning station 11 and the first printing station A and the second positioned between the image-fixing station 16 and the cutting station 20. The drive rollers 22*a*, 22*b* are driven by controllable motors, 23*a*, 23*b*. One of the motors 23*a*, 23*b* is speed controlled at such a rotational speed as to convey the web through the printer at the required speed, which may for example be about 125 mm/sec. The other motor is torque controlled in such a way as to generate a web tension of, for example, about 1 N/cm. Referring to FIG. 2, each printing station comprises a cylindrical drum 24 having a photoconductive outer surface 26. Circumferentially arranged around the drum 24 there is a charging device 28 capable of uniformly charging the drum surface, an exposure station 30 which will image-wise and line-wise expose the photoconductive drum surface causing the charge on the latter to be selectively dissipated, leaving an image-wise distribution of electric charge to remain on the drum surface. This so-called "latent image" is rendered visible by a developing station 32 which brings a toner developer in contact with the drum surface 26. The toner particles are attracted to the latent image on the drum surface by the electric field between the drum surface and the developer so that the latent image becomes visible. After development, the toner image adhering to the drum surface 26 is transferred to the moving web 12 by a transfer corona device 34. The moving web 12 is in face-to-face contact with the drum surface 26 over a wrapping angle ω of about 15° determined by the position of guide rollers 36. The transfer corona device, being on the opposite side of the web to the drum, and having a high potential opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about ±3 μA/cm. The transfer corona device 34 also serves to generate a strong adherent force between the web 12 and the drum surface 26, causing the latter to be rotated in synchronism with the movement of the web 12. Circumferentially beyond the transfer corona device 34 there is positioned a web discharge corona device 38 driven by alternating current. Thereafter, the drum surface 26 is pre-charged by a corona 40, causing any residual toner which might still cling to its surface to become loosened so that it may be collected at a cleaning unit 42 known in the art. The cleaning unit 42 includes a rotating cleaning brush 43. After cleaning, the drum surface is ready for another recording cycle. After passing the first printing station A, as described above, the web passes successively to printing stations B, C, D and E, where images in other colours are transferred to the web. It is critical that the images produced in successive stations be in register with each other. In order to achieve this, the start of the imaging process at each station has to be critically timed. In the conditioning apparatus shown in FIG. 3, the paper web 12 is unwound from a supply roll 14 and led through an entrance slit 53 into a heating cabinet 54 wherein the paper web 12 follows a curved path defined by a plurality of rollers 100. Between the first and second of said rollers 100, the paper web is in contact with a metal heating drum 55, having a tubular infrared heating source 56 inside. The heating drum may mainly consist of aluminium or copper. In a preferred embodiment, the temperature of the heating drum 55 is sensed by a temperature sensor 85. The signal of this temperature sensor 85 may be fed to an electronic control device 101 to control the output of the infrared heating source 56, especially when the apparatus is in a standby status, i.e. when no paper transport takes place. A fan 57 mounted in a wall of the cabinet 54 expels moist air out of the cabinet 54 while ambient air enters through the inlet slits 58. The heated paper web 12 passes through a slot 59 into a cooling cabinet 60, wherein by means of ventilators 61 and 62 cold dry air is circulated along both sides of the paper web 12, as indicated by the arrows 63 and 64. The cooling box 65 has a tight entrance slit 66 closed by a felt brush and contains heat-exchangers 67 and 68 in which circulating cold water (at a temperature of for example 1° to 7° C.) is passed, through cold water inlets 69 and outlets 70. A reservoir (not shown) is connected to the drain holes 77 of the cooling box 65 to collect condensed water which is then led to a drain. The paper web 12 leaves the cooling box 65 via a tight exit slit 71 and enters a housing 78 containing a sensing means. The paper web 12 follows a curved path into contact with an earthed metal drum 72. This drum may mainly consists of iron or steel. In a preferred embodiment, the drum 72 is kept at a temperature equal to that of the paper web after cooling. This may be achieved by a lamp (not shown) or by cooling, irradiating the drum 72 where it is not covered by the web 12. The paper web 12 then follows the surface of the drum 72, closely adjacent a DC corona discharge unit 73, also referred to as transfer corona. This unit 73 sprays electrical charge on the paper web 12, from which the paper thus receives a predetermined corona charge. The paper web 12 then passes an electrometer head 74, also referred to as (contactless) electrostatic voltage sensor, downstream of the corona discharge unit 73, which measures the remaining charge level as a voltage which is related to the electrical condition of the paper. The signal from the electrometer head 74 passes via a line 102 to the electronic control device 101. The control device 101 processes said signal in accordance with a previous calibration of the apparatus and controls the supply of electrical power via line 103 to the heating source 56 to automatically adjust the heat energy supply in accordance with the remaining charge level sensed by the electrometer 74 to bring the condition of the paper within the desired range. Then the corona current is about 3 $\mu$A/cm and the thickness of the paper is about 100 $\mu$m, with a weight of 100 g/m$^2$, for good subsequent toner transfer results the electrometer should typically detect a charge height of at least 500 V. The operation of the electronic moisture control device may be explained as follows. The electrostatic voltage measured by the electrometer 74 will we be lower than the electrostatic voltage generated on the web materiel at the location of the corona discharge unit 73. This is due to the fact that the electrical charge sprayed on the web material by the corona discharge unit 73 partially leaks away via the earthed metal drum 72, due to contacting the drum. The amount of charge leaking away is a function of the time that the web material is in contact with the drum. This time is inversely proportional to the angular velocity of the drum 72 and proportional to the distance between the corona discharge unit 73 and the electrometer head 74. The amount of charge leaking away is also a function of the conductivity of the web material. If the web material has a high conductivity, then the amount of dissipated charge will be high ; a low conductivity will cause a low amount of electrical charge to leak away to the earthed metal drum 72. It has now been found that the conductivity, or more precisely, the amount of charge leaking away per unit of time, is not only a function of the moisture content of the cooled web material, but also a function of the temperature of the cooled web material. It has been found that the conductivity raises with raising temperature, even if the moisture content is kept constant. This causes the following problem in prior art systems. If the temperature of the cooled web material is higher than the reference temperature, e.g. 25° C., then the electrometer 74 will detect a voltage e.g. lower than 360 V, which is considered as being due to a high leakage of charge. The electronic moisture control device 101 may interpret this high leakage as a high moisture content of the web material and accordingly increase the radiant output of the infrared heating source 56 to increase the temperature of the heating drum 55. Since the heated media gets warmer by this extra energy, the media after cooling in the cooling box 65 will also get a higher temperature, e.g. 31° C. This higher temperature of the cooled web material dramatically increases the conductivity measured by the electrometer 74, although the moisture content may have decreased due to the higher temperature of the heated web material in the heating cabinet 54. Therefore, the electronic moisture control device 101 may command an even higher radiant power for the infrared heating source in an attempt to lower the conductivity of the web material 12. It is clear that this system drifts away from its optimal and preferably stable working point. Another disadvantage is that the temperature of the cooled web material as it leaves the housing 78 will not be stable. This may cause the paper length to shrink at higher temperature levels or stretch at lower temperature levels, which may cause problems for subsequent registering of partial colour images transferred by the transfer corona devices 34 or paper length problems in the cutting station 20. Due to variation of the temperature, the ratio of the cutting length to the effective paper size may vary considerably. To avoid the above problems, according to the invention a temperature sensor 81 is located close to the cooled web material, preferably after it left the cooling box 65. In a more preferred embodiment, the temperature sensor 81 is located close to the periphery of the drum 72, where the web material 12 is in contact with the drum. The signal generated by the temperature sensor 81 is transmitted via a temperature sensor line 82 to an electronic temperature control device 83. This control device 83 transmits a signal via a signal line 84 to the cooling box 65 to increase or decrease the cooling power of the cooling box 65. The temperature control device 83 operates in such a manner that the temperature sensed by the sensor 81 is constant or situated within a narrow temperature range of 2° C. or less. If the control device 83 gets a temperature signal indicative of a temperature higher than the predetermined range, then the control device 83 instructs the cooling box to increase the cooling power. If the temperature of the cooled web material is too low, then the cooling power of the cooling box 65 is decreased, such that the web material leaving exit slit 71 gets a higher temperature.

By sensing the temperature of the cooled media and using the temperature signal 82 to control the cooling power of the cooling box 65, the temperature of the web material leaving the cooling box 65 is kept substantially constant. This has two advantages. First of all, the conductivity or electrostatic charge leakage is more closely related to the moisture content of the heated and subsequently cooled media. On the other hand, the temperature of the media leaving the housing 78 is substantially constant, such that other process parameters, which may by highly dependent on the temperature of the media, can be controlled independently from the temperature. As explained before, the length and width of the media may be influenced by the temperature.

The cooling box will produce frigories (i.e. 'cold calories') for cooling the web material. In this process, calories are inevitably generated partly due to the cooling process, partly due to the mechanical and electrical energy losses. In a preferred embodiment, the calories generated by the cooling box 65 may be recuperated by the heating process. This may be done for example by use of a Peltier module such as described in U.S. Pat. No. 4,519,389 or EP-A- 0 651 308. The cold side or junction of the Peltier module may produce the frigories for the cooling box 65, the hot junction may produce the calories for the heating means 55, or an air flow cooling the hot junction may be guided to the inlet slits 58 of the heating cabinet 54. This way heat energy dissipated or withdrawn from the cooling means 65 may be transported to the heating means 55 and heat energy may be recuperated.

Figure 4:
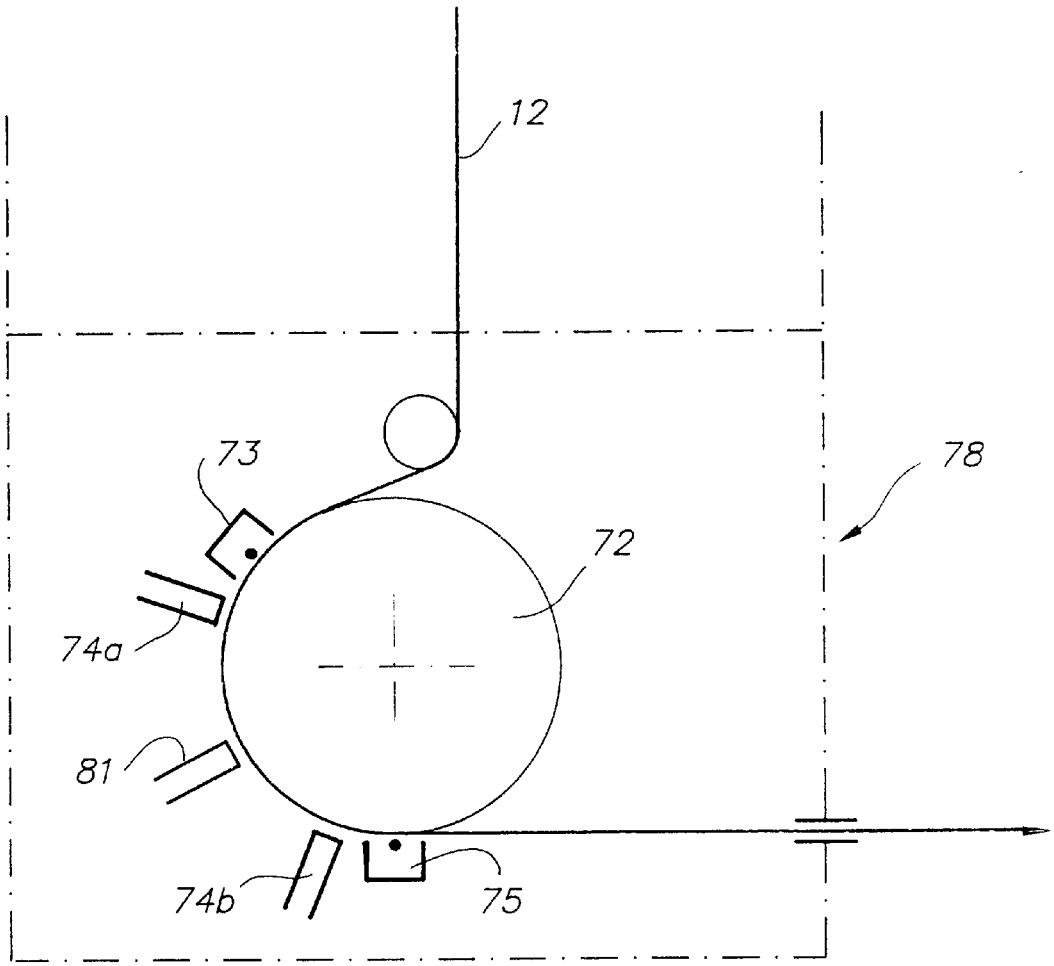
FIG. 4 shows a modification of part of the apparatus shown in FIG. 3, according to an alternative embodiment of the invention.

An AC discharge corona 75, also referred to as erase corona, positioned downstream of the electrometer head 74 brings the paper web back to its ground state before it leaves the housing 78 through the exit slot 76. This measure is taken to avoid that the web material 12 sticks to the drum 72 at the point where the material has to leave the drum. The paper web passes from the exit slot 76 directly into the printer shown in FIG. 1. By directly coupling the conditioning unit to the printer, the web drive for the printer serves to drive the paper web 12 from its supply roll 14 through the conditioning apparatus, the paper web being maintained in a tensioned state by the brake 15 acting on the roll 14. The output signal from the electrometer head 74 and from the temperature sensor 81 may alternatively or additionally be fed to a visual indicator from which the operator may check the condition of the paper web. In the alternative embodiment shown in FIG. 4, two spaced electrometer heads 74*a* and 74*b*, also referred to as (contactless) electrostatic voltage sensors, are positioned adjacent the paper web path downstream of the corona discharge unit 73. The temperature sensor 81 gives feedback about the temperature of the moving paper web 12. That information is used to control the cooling power of the cooling box 65, such that the temperature of the paper in the housing 78 is kept within a narrow temperature range. At such almost constant temperature, the electrostatic charge leakage, measured by the electrometers 74*a* and 74*b*, is more closely related to the moisture content of the cooled paper web material. In this embodiment, the control device (not shown in FIG. 4) compares the signals received from the two electrometers 74*a* and 74*b* to determine the rate of decay of electrostatic charge on the paper web. This rate of decay, being indicative of the electrical condition of the paper web, is then used to automatically adjust the heat energy supply in accordance with the rate of charge decay sensed by the electrometer heads 74*a,* 74*b* to bring the condition of the paper within the desired range. The embodiment shown in FIG. 4 has the advantage over that shown in FIG. 3, of not requiring previous calibration. Alternatively, the voltage or the electrical current of the corona discharge unit 73 may be controlled by the output signal of the first electrometer 74*a*, in such a way that the electrostatic voltage sensed by the electrometer 74*a* has a predetermined constant level of e.g. 500 V. In such case, either the output signal of the second electrometer 74*b* alone or a difference signal from both electrometers 74*a* and 74*b* may be sent to the electronic moisture control device 101. According to that embodiment of the invention, the temperature sensor 81 is preferably located between the first electrometer 74*a* and the second electrometer 74*b*. Alternatively, the temperature sensor 81 may be located at any location close to where the web material 12 is in contact with the drum 72.

In an alternative embodiment, the output signal from the temperature sensor 81 may control other portions of the printer 10. Parameters such as cut length, transfer current in transfer corona device 34 and image scales may be varied as a function of the temperature measured by sensor 81. In such case, the temperature may vary for example between 24° C. and 26° C. or higher, without correcting the cooling power of the cooling box 65. The temperature signal 82 may then be fed (not shown) to the electronic moisture control device 101 in order to correct the moisture signal 102 for the higher or lower temperature.

Parts list

10. printer
11. media conditioning apparatus
12. moving web material
13. supply station
14. supply roll of web material
15. brake
16. image-fixing station
20. cutting station
22*a*. drive roller
22*b*. drive roller
23*a*. controllable motor
23*b*. controllable motor
24. cylindrical drum
26. photoconductive outer drum surface
28. charging device
30. exposure station
32. developing station
34. transfer corona device
36. guide rollers
38. discharge corona device
40. corona
42. cleaning unit
43. rotating cleaning brush
44. printer housing
46. support column
48. platform
50. spring
51. spring
52. stacker
53. entrance slit
54. heating cabinet
55. heating drum
56. infrared heating source
57. fan
58. inlet slits
59. slot
60. cooling cabinet
61. ventilator
62. ventilator
63. arrow
64. arrow
65. cooling box
66. entrance slit
67. heat-exchanger
68. heat-exchanger
69. cold water inlets
70. cold water outlets
71. exit slit
72. earthed metal drum
73. corona discharge unit
74. electrometer
74*a*. electrometer
74*b*. electrometer
75. AC discharge corona
76. exit slot
77. drain holes
78. housing
81. temperature sensor
82. temperature sensor line
83. electronic temperature control device
84. line
85. temperature sensor
100. rollers
101. electronic moisture control device
102. moisture signal line
103. line

What is claimed is:

1. An apparatus for conditioning moisture content of media comprising:

heating means for heating said media cooling means for cooling said heated media moisture sensor for sensing the moisture content of said cooled media thereby generating a moisture signal;

first control means for controlling said heating means in response to said moisture signal;

a temperature sensor for sensing a temperature of said cooled media thereby generating a temperature signal;

second control means for controlling said cooling means in response to said temperature signal.

2. The apparatus according to claim 1, wherein said moisture sensor comprises a conductivity sensor for sensing a conductivity of said media.

3. The apparatus according to claim 2, wherein said conductivity sensor comprises:

a charge generator for generating an electrostatic charge on said cooled media;

a charge detector for generating said moisture signal.

4. The apparatus according to claim 3, wherein said conductivity sensor further comprises a second charge detector for calibrating said moisture signal.

5. The apparatus according to claim 1, comprising means for transporting heat energy from said cooling means to said heating means.

6. The apparatus according to claim 1, wherein said media is in the form of a web.

7. A method for conditioning moisture content of media comprising the steps of:

heating said media by heating means;

cooling said heated media by cooling means;

sensing the moisture content of said cooled media thereby generating a moisture signal;

controlling said heating means in response to said moisture signal;

sensing a temperature of said cooled media thereby generating a temperature signal;

controlling said cooling means in response to said temperature signal.

8. The method according to claim 7, wherein the step of sensing the moisture content comprises the step of sensing a conductivity of said media.

9. The method according to claim 8, wherein the step of sensing a conductivity comprises the steps of:

generating an electrostatic charge on said cooled media by a charge generator; and generating a moisture signal by a charge detector.

10. The method according to claim 9, wherein the step of sensing a conductivity comprises the step of calibrating said moisture signal by a second charge detector.

11. The method according to claim 7, further comprising the step of transporting heat energy from said cooling means to said heating means.

12. The method according to claim 7, wherein said media is in the form of a web.

* * * * *